United States Patent [19]

Landa

[11] 4,364,657

[45] Dec. 21, 1982

[54] MULTIPLE-BLADE PICKOFF FOR ELECTROPHOTOGRAPHIC COPIER

[75] Inventor: Benzion Landa, Alberta, Canada

[73] Assignee: Savin Corporation, Valhalla, N.Y.

[21] Appl. No.: 190,351

[22] Filed: Sep. 24, 1980

[51] Int. Cl.[3] ..... G03G 15/00

[52] U.S. Cl. ..... 355/3 SH; 271/309; 271/312; 271/DIG. 2

[58] Field of Search ..... 355/3 TR, 3 SH; 271/DIG. 2, 309, 312, 313

[56] References Cited

U.S. PATENT DOCUMENTS

| | | | |
|---|---|---|---|
| 3,450,402 | 6/1969 | Weiler | 271/308 |
| 4,026,541 | 5/1977 | Brooke | 271/DIG. 2 |
| 4,072,307 | 2/1978 | Knieser | 271/313 |

OTHER PUBLICATIONS

*IBM Tech. Disc. Bull.,* "Paper Detack Device", vol. 22, No. 10, Mar. 1980, p. 4401.

*Primary Examiner*—R. L. Moses
*Attorney, Agent, or Firm*—Shenier & O'Connor

[57] ABSTRACT

Apparatus for separating a copy sheet from a photoconductive imaging surface in an electrophotographic copier following image transfer in which a plurality of guides are stationarily disposed at transversely spaced locations across the imaging surface at sufficiently small spacings therefrom to intercept the leading edge of a copy sheet moving past the guides and separate the sheet edge from the surface. The guides are disposed at progressively retarded positions relative to the movement of the imaging surface to effect laterally progressive peeling of the leading edge of the copy sheet from one lateral edge to the other and have such progressively decreasing lengths along arcuate guide paths as to compensate for their progressively retarded positions and direct the sheet onto an exit path with a leading edge orientation corresponding to its original orientation in the transfer station. To achieve initial separation, the first guide is disposed at a spacing from the imaging surface less than the thickness of a copy sheet and is assisted by a pulsed air jet against the adjacent leading sheet edge portion. A pressure roller in the transfer station clamps the sheet portion behind the sheet edge intercepting the air jet to prevent air from flowing through the region between the sheet and the imaging surface and undesirably reducing the pressure in that region.

7 Claims, 5 Drawing Figures

MULTIPLE-BLADE PICKOFF FOR ELECTROPHOTOGRAPHIC COPIER

BACKGROUND OF THE INVENTION

This invention relates to apparatus for separating a copy sheet from a moving photoconductive imaging surface of an electrophotographic copier following transfer of a developed image from the imaging surface to a copy sheet.

In electrophotographic copiers of the so-called plain paper type, an electrostatic image of an original is first formed and developed on a suitable photoconductive imaging surface, such as the surface of a cylindrical drum, and then transferred to a separate sheet of paper, usually by mechanical pressure, electrostatic force or both. Owing to various attractive or adhesive forces developed between the copy sheet and the imaging surface during image transfer, particularly where a liquid developer is used, the copy sheet does not separate readily from the imaging surface but must be assisted by some type of pickoff.

One type of pickoff apparatus of the prior art directs a relatively high-velocity jet of air or other gas against a sheet edge portion as it emerges from the transfer station. In theory, the high-velocity stream in the region overlying the edge portion reduces the pressure in that region, allowing the unreduced pressure of the air trapped in the region underlying the same sheet portion to lift the sheet. In practice, however, some of the air from the jet enters the region between the sheet and the imaging surface, reducing the pressure in that region as well so as to lessen, often significantly, the pressure differential actually achieved.

Another type of pickoff of the prior art uses a mechanical element such as a blade which rides on the imaging surface so as to intercept the leading edge of the copy sheet as it moves past the element. Since such an element continually rides on and thus abrades an image-bearing portion of the photoconductive surface, the useful life of the surface is undesirably reduced.

SUMMARY OF THE INVENTION

One of the objects of my invention is to provide a copy sheet pickoff which is simple and certain in operation.

Another object of my invention is to provide a copy sheet pickoff which advantageously utilizes an air jet to create a pressure differential between opposite sides of the copy sheet.

A further object of my invention is to provide a copy sheet pickoff which does not damage the imaging surface or smear the transferred image on the copy sheet.

Yet another object of my invention is to provide a copy sheet pickoff which exploits the natural flexural characteristics of paper.

Still another object of my invention is to provide a copy sheet pickoff which handles the separated copy sheet without causing skewing.

Other and further objects will be apparent from the following description.

In one aspect, my invention contemplates apparatus for separating a copy sheet from a photoconductive imaging surface following image transfer in which a jet of gas such as air is directed against an edge portion of the copy sheet to lift the portion from the imaging surface while, at the same time, the sheet portion behind the edge portion with reference to the direction of the jet is clamped against the imaging surface to prevent gas from flowing through the region between the sheet and the imaging surface. Preferably, a roller such as the transfer roller in the transfer station is used to clamp the sheet portion behind the edge portion. By clamping this sheet portion to the imaging surface to prevent gas from flowing through the underlying region, I am able to increase significantly the effectiveness of the gas jet, since the pressure in that region remains undiminished.

In another aspect, my invention contemplates sheet separating apparatus in which a guide is stationarily disposed adjacent to the imaging surface at a predetermined spacing less than the thickness of a copy sheet therefrom to intercept without contacting the imaging surface the leading edge of a copy sheet moving past the guide and separate the sheet edge from the imaging surface.

In yet another aspect, my invention contemplates sheet separating apparatus in which a plurality of guides are stationarily disposed at transversely spaced locations across the imaging surface at progressively retarded positions relative to the movement of the imaging surface and at such spacings therefrom as to intercept in a laterally progressive manner the leading edge portion of a copy sheet moving past the guides and separate the edge from the surface. Preferably, the guides are so shaped as to direct the sheet along arcuate guide paths onto an exit path and have such progressively decreasing lengths along the arcuate guide paths as to compensate for the progressively retarded positions of the guides and direct the sheet onto the exit path with a leading edge orientation corresponding to its original orientation in the transfer station.

BRIEF DESCRIPTION OF THE DRAWINGS

In the accompanying drawings to which reference is made in the instant specification and which are to be read in conjunction therewith and in which like reference characters are used to indicate like parts in the various views:

FIG. 3 is a right side elevation of the copier and pickoff apparatus shown in FIG. 1, with parts omitted.

DESCRIPTION OF THE PREFERRED EMBODIMENT

Figures 1, 2:
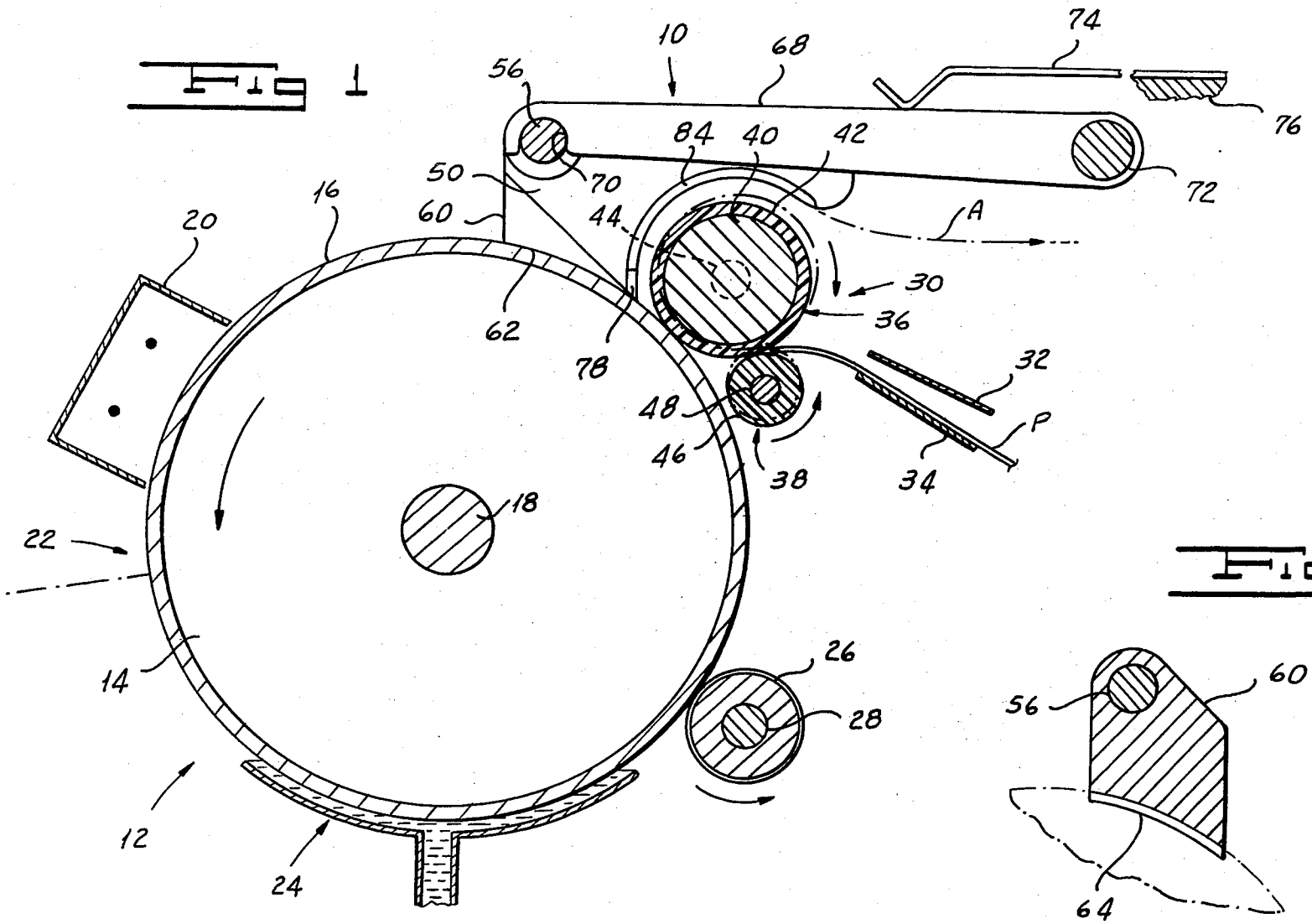
FIG. 1 is a section of an electrophotographic copier incorporating my pickoff apparatus.
FIG. 2 is a section of one of the spacers for the guides of my pickoff apparatus, taken along line 2—2 of FIG. 3.
Figure 1:
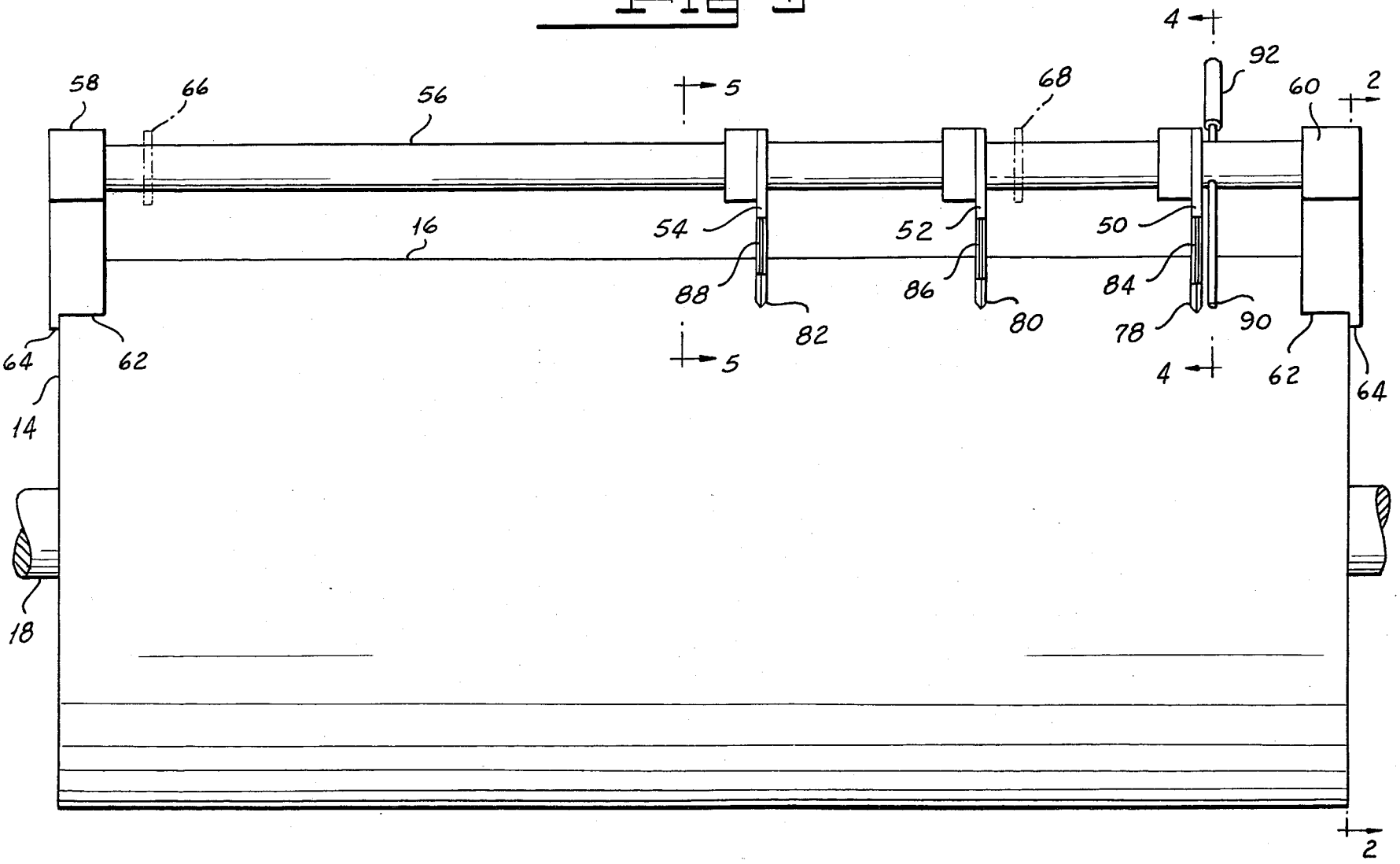
Figure 4:
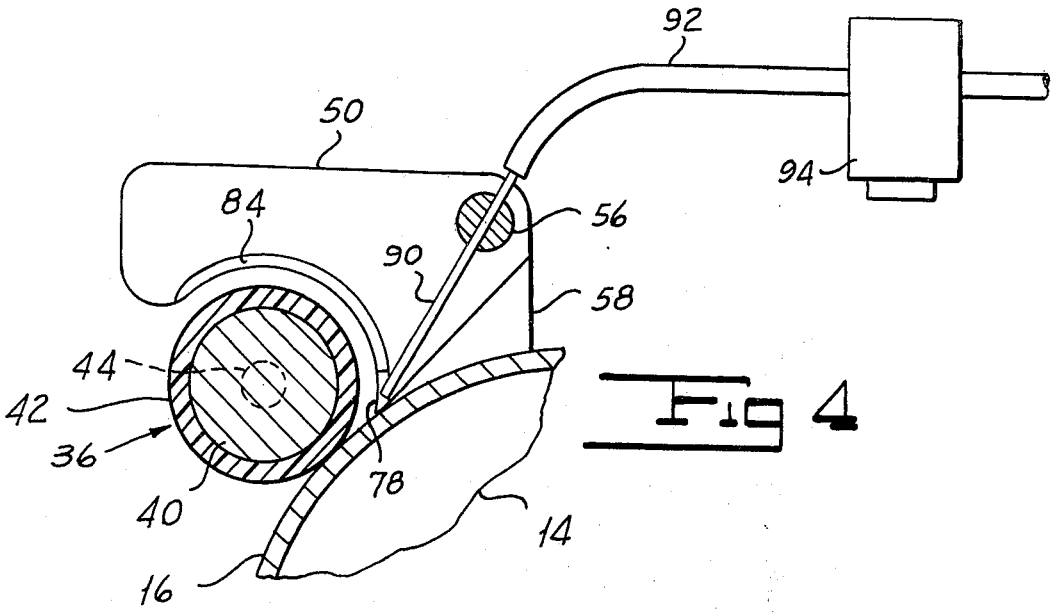
FIG. 4 is a section of the pickoff apparatus shown in FIG. 1, taken along line 4—4 of FIG. 3.
Figure 5:
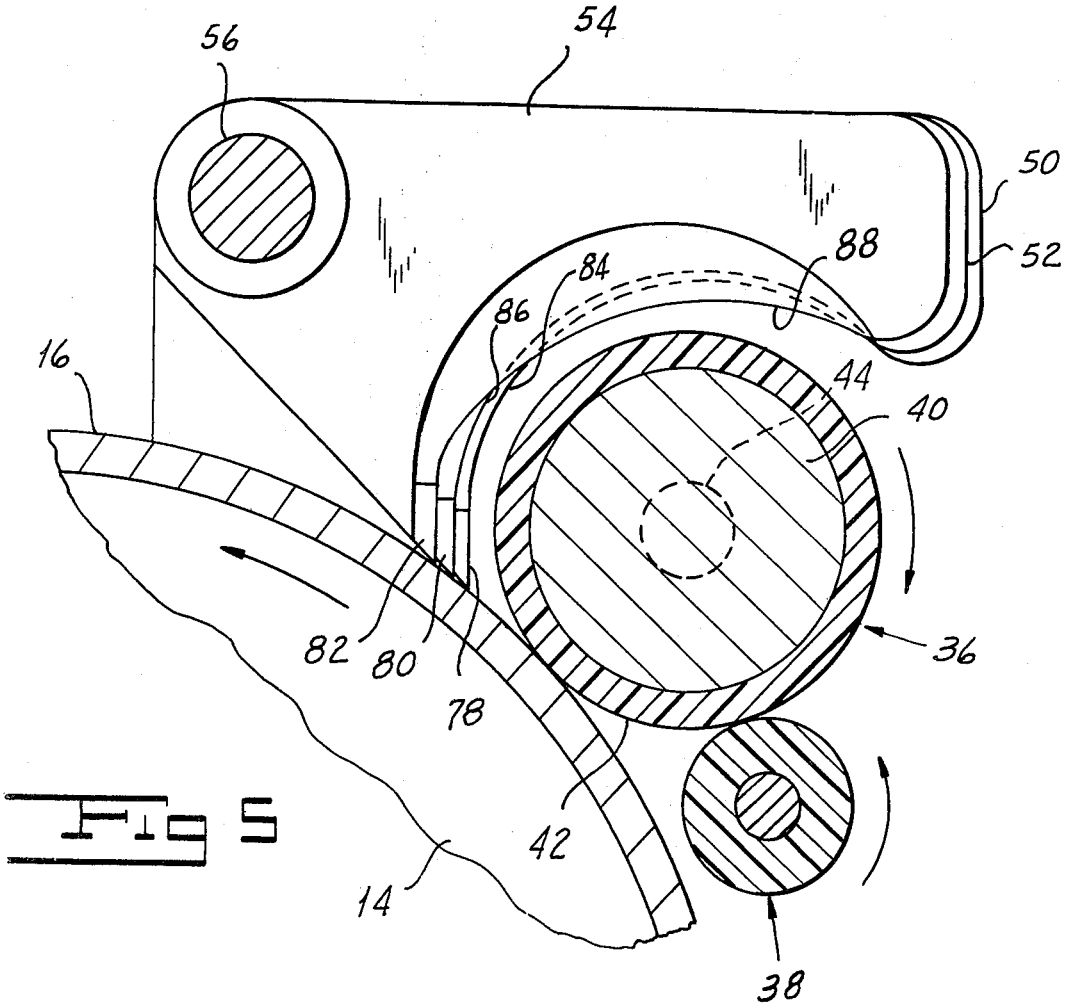
FIG. 5 is an enlarged section of the pickoff apparatus shown in FIG. 1, taken along line 5—5 of FIG. 3.

Referring now to the drawings, my pick-off apparatus, indicated generally by the reference numeral 10, is used in an electrophotographic copier indicated generally by the reference numeral 12. Copier 12 includes a cylindrical drum 14 which has a photoconductive outer imaging surface 16 and which is rotatably supported on a shaft 18. To make a copy of an original (not shown), the drum surface 16 is first moved past an adjacently disposed corona charger 20 which supplies the drum surface with a uniform electrostatic charge. The drum surface 16 next moves through an exposure station, indicated generally by the reference numeral 22, in which the surface is exposed to a stripwise image of an original to discharge selectively areas of the drum surface 16 to form an electrostatic latent image. After exposure, the drum surface 16 moves through a developing station, indicated generally by the reference numeral 24, in which a liquid developer is applied to the drum surface to form a developed image corresponding to the latent image in a manner well known in the art. Next, the drum surface 16 moves past a roller 26 supported on a shaft 28. Roller 26 is spaced slightly from the surface 16 of drum 14 and is rotated at a high speed in the reverse direction relative to the direction of movement of the drum surface 16 at the point of adjacency to remove excess developer liquid from the developed image.

After passing roller 26, the portion of surface 16 bearing the developed image next moves through a transfer station, indicated generally by the reference numeral 30, in which the developed image on the drum surface 16 is transferred to a sheet of plain copy paper P. In the transfer station 30, which I describe in more detail in my copending application Ser. No. 85,689, filed Oct. 17, 1979 now U.S. Pat. No. 4,302,093, I feed copy sheet P between an upper guide 32 and a lower guide 34 in synchronism with the movement of the drum surface 16 to the nip formed by a relatively large-diameter transfer roller 36 and a smaller-diameter registration roller 38. Transfer roller 36 comprises an elastomer outer layer 42 disposed around a metal core 40 which is carried by a shaft 44. Preferably, outer layer 42 is slightly conductive and core 40 coupled to a suitable source of biasing potential (not shown) to assist in the transfer of the developed image from the surface 16 to the sheet P. Registration roller 38 comprises an outer layer 46 of similar elastomer carried by a shaft 48.

Initially, as described in my copending application referred to above, rollers 36 and 38 are stationary in the dot-dash positions shown in FIG. 1, with transfer roller 36 spaced slightly from the surface 16 of drum 14. Upon the arrival in the transfer station 30 of the leading edge of the developed image on the drum surface, roller 36 is moved to the solid-line position in FIG. 1 in which it is spaced from the drum surface 16 by a distance less than the thickness of the copy sheet P. Registration roller 38 also moves slightly to the solid-line position shown in FIG. 1 to remain in engagement with roller 36. Simultaneously with the movement of roller 36 toward drum surface 16, roller 36 is driven in a clockwise direction as viewed in the same figure to move the copy sheet P through the nip now formed by the roller 36 and the drum surface 16. As the sheet P moves through this latter nip, surface 16 transfers to the adjacent surface of the sheet the major portion of the toner particles forming the developed image.

The pickoff apparatus 10 of the copier 12 comprises a plurality of guides 50, 52 and 54 carried by a transversely extending shaft 56 at variously spaced locations from a lateral edge of the copy sheet P. I support shaft 56, and hence guides 50, 52 and 54, in predetermined spaced relationship with the drum surface 16 by means of a pair of spacer shoes 58 and 60 which receive the near and far ends, respectively, of shaft 56. Each of the spacer shoes 58 and 60, which are formed from a suitable low-friction material such as the synthetic resin sold by E. I. duPont de Nemours & Co. under the trademark DELRIN, is formed with a lower surface portion 62 shaped to ride on the surface 16 of the drum 14, as shown in FIG. 1. In addition, shoes 58 and 60 are formed with stepped portions, outboard of portions 62, which extend radially inwardly of the drum surface 16 so as to locate the shaft 56 axially relative to drum 14, as shown in FIG. 3. Slots 70 formed at the end of transversely spaced pivot arms 66 and 68 carried by pivot shaft 72 serve to locate shaft 56 circumferentially relative to drum 14. Respective biasing springs 74 attached to a frame portion 76 of the copier 12 bear downwardly against arms 66 and 68 to urge shaft 56 and shoes 58 and 60 radially inwardly relative to the drum 14.

Guide 50, which is disposed about 5 mm from the lateral edge of the sheet P, is formed with a vertically extending blade or knife edge 78, the lower tip of which is spaced from the drum surface 16 by a distance less than the thickness of the copy sheet 16. Preferably, the lower tip of knife edge 78 is disposed about 10 mm downstream from the nip formed by transfer roller 36 and drum surface 16. As the drum surface 16 carries the leading edge of the copy sheet P past knife edge 78, the knife edge lifts the adjacent leading sheet portion from the drum surface 16 to redirect it along an upward trajectory. After the leading edge of copy sheet P clears the upper end of knife edge 78, it continues to follow a path defined by a polyester film strip 84 carried by guide 50. Strip 84 directs the sheet P along an arcuate path spaced from and extending generally around the outer surface of roller 36 onto an exit path A shown in FIG. 1 leading to a suitable exit assembly (not shown).

Guide 52, which is spaced laterally from guide 50 relative to the direction of sheet movement, includes a knife edge 80 which is similar to the knife edge 78 of guide 50 except that its lower tip is spaced slightly downstream relative to the tip of knife edge 78. That is, the tip of knife edge 80 is circumferentially spaced from the nip of roller 36 and surface 16 by a slightly greater distance than that of knife edge 78. Thus, rather than engaging knife edge 80 at the same time as knife edge 78, the copy sheet P begins to peel first at the edge nearest guide 50 and shoe 60. As a result of this progressive peeling action, the leading edge of sheet P is lifted slightly from the drum surface 16 by the time it reaches knife edge 80. Knife edge 80 thus readily directs the adjacent leading edge portion of sheet P upwardly to a polyester film strip 86 carried by guide 52. Strip 86 defines a guide path which is generally similar to that of strip 84, but which generally passes more closely around roller 36 to compensate for the increased path length between the nip of roller 36 and surface 16 and blade 80. Without this compensation, the sheet P would follow a skew exit path, with its leading edge out of alignment with its original orientation, owing to the greater distance that would have been traversed by portions remote from the initially stripped edge.

Guide 54, which is laterally spaced from guide 52 on the other side from guide 50, includes a knife edge 82 which is similar to knife edges 78 and 80 of guides 50 and 52, but which is spaced even farther downstream than knife edge 80 to continue the progressive peeling action initiated by the relative circumferential spacing of knife edges 78 and 80. Knife edge 82 directs the adjacent leading edge portion of sheet P upwardly to a polyester film strip 88 carried by guide 54. Strip 88 defines a guide path generally similar to those of strips 84 and 86, but which generally passes even more closely around roller 36 to compensate for the increased path length between the nip of roller 36 and surface 16 and blade 82.

To increase the reliability of the initial stripping action of the knife edge 78, especially with thin or excessively wet sheets or if the knife edge is spaced from the drum surface by a distance greater than the thickness of a sheet, I direct an air jet against the adjacent leading edge portion of sheet P from a needle 90 received by a diametric bore in shaft 56. A flexible hose 92 couples the end of needle 90 remote from surface 16 to a suitable source of pressurized air (not shown). Preferably a solenoid-controlled valve 94 is used to supply needle 90 with a pulse of pressurized air at a time coincident with the arrival of the leading edge of the sheet P at knife edge 78. The actuation of solenoid 94 to produce an air jet at a time coincident with the arrival of the sheet may be controlled by any suitable means, such as by the sheet photodetector and timer circuit shown in U.S. Pat. No. 4,168,840, issued to Hori et al.

While it is possible to dispose additional guides across the remaining portion of the sheet feed path to the left of guides 50 to 54 as shown in FIG. 3, I have found it unnecessary to use such additional guides to span all or even half of the width of the feed path. Guides 50 to 54 are effective without further assistance to initiate a peeling action across the entire width of the sheet P.

It will be seen that I have accomplished the objects of my invention. My copy sheet pickoff advantageously utilizes an air jet to create a pressure differential between opposite sides of the copy sheet. My pickoff is simple and certain in its operation, yet does not damage the imaging surface or smear the transferred image on the copy sheet. My copy sheet pickoff exploits the natural flexural characteristics of paper and handles the separated copy sheet without causing skewing.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention what I claim is:

1. In an electrophotographic copier having a photoconductor, means for forming a developed toner image on said photoconductor, and means for moving said photoconductor past said image-forming means, the improvement comprising a roller, means for positioning said roller across said photoconductor to form a nip, means for feeding a carrier sheet to said nip with a predetermined leading edge orientation to transfer said developed image to said sheet, means for directing a jet of gas against a leading edge portion of said carrier sheet as it emerges from said nip to lift the adjacent sheet portion from said photoconductor, a plurality of pickoff elements, and means for positioning said pickoff elements at transversely spaced locations across said photoconductor at progressively retarded positions following said roller sequentially to receive the leading edge of said carrier sheet, whereby said leading edge loses said predetermined orientation, said elements having respective guide surfaces defining an arcuate path around said roller of such progressively changing curvature across said photoconductor as to restore said predetermined leading edge orientation.

2. In an electrophotographic copier having a photoconductor, means for forming a developed toner image on said photoconductor, and means for moving said photoconductor past said image-forming means, the improvement comprising as roller, means for positioning said roller across said photoconductor to form a nip, means for feeding a carrier sheet to said nip with a predetermined leading edge orientation to transfer said developed image to said sheet, a plurality of pickoff elements, and means for positioning said pickoff elements at transversely spaced locations across said photoconductor at progressively retarded positions following said roller sequentially to intercept the leading edge of said carrier sheet, whereby said leading edge loses said predetermined orientation, said elements having respective guide surfaces defining an arcuate path around said roller of such progressively changing curvature across said photoconductor as to restore said predetermined leading edge orientation.

3. In an electrophotographic copier having a photoconductor, means for forming a developed toner image on said photoconductor, means for supplying a carrier sheet to said photoconductor with a predetermined leading edge orientation to permit transfer of said developed image to said sheet, and means for moving said photoconductor past said image-forming means and said sheet-supplying means, the improvement comprising means for directing a jet of gas against a leading edge of said carrier sheet following said transfer to lift the adjacent sheet portion from said photoconductor, means for clamping said sheet to said photoconductor at a location spaced from said edge portion, a plurality of pickoff elements, and means for positioning said pickoff elements at transversely spaced locations across said photoconductor at progressively retarded positions sequentially to receive the leading edge of said carrier sheet, whereby said leading edge loses said predetermined orientation, said elements having respective guide surfaces defining an arcuate path of such progressively changing curvature across said photoconductor as to restore said predetermined leading edge orientation.

4. In an electrophotographic copier having a photoconductor, means for forming a developed toner image on said photoconductor, means for supplying a carrier sheet to said photoconductor with a predetermined leading edge orientation, means for transferring said developed image to said sheet, and means for moving said photoconductor past said image-forming means and said transferring means, the improvement comprising a plurality of pickoff elements and means for positioning said pickoff elements at transversely spaced locations across said photoconductor at progressively retarded positions sequentially to intercept the leading edge of said carrier sheet, whereby said leading edge loses said predetermined orientation, said elements having respective guide surfaces defining an arcuate path of such progressively changing curvature across said photoconductor as to restore said predetermined leading edge orientation.

5. In an electrophotographic copier having a photoconductor, means for forming a developed toner image on said photoconductor, means for supplying a carrier sheet to said photoconductor with a predetermined leading edge orientation, means for transferring said developed image to said sheet, and means for moving said photoconductor past said image-forming means and said transferring means, the improvement comprising means for mechanically intercepting the leading edge of said carrier sheet at progressively retarded positions across said photoconductor to separate said carrier sheet therefrom, whereby said leading edge loses said predetermined orientation, and means for directing said sheet along an arcuate path of such progressively changing curvature across said photoconductor as to change the direction of travel of said sheet while restoring said predetermined leading edge orientation.

6. In an electrophotographic copier having a photoconductor, means for forming a developed toner image on said photoconductor, means for supplying a carrier sheet to said photoconductor, and means for moving said photoconductor past said image-forming means and said sheet-supplying means, the improvement comprising means for directing a jet of gas against an edge portion of said carrier sheet to lift the adjacent sheet portion from said photoconductor, a roller, and means for positioning said roller in engagement with said sheet at such a location spaced approximately one centimeter from said edge portion as to entrap gas in the region beneath said adjacent sheet portion and substantially prevent escape of gas therefrom to cause the pressure of said gas to lift said sheet portion from said photoconductor.

7. In an electrophotographic copier having a photoconductor, means for forming a developed toner image on said photoconductor, means for supplying a carrier sheet to said photoconductor to permit transfer of said developed image to said sheet, the improvement comprising means for directing a jet of gas against an edge portion of said carrier sheet to lift the adjacent sheet portion from said photoconductor and means for clamping said sheet to said photoconductor at such a location spaced approximately one centimter of said edge portion as to entrap gas in the region beneath said adjacent sheet portion and substantially prevent escape of gas therefrom to cause the pressure of said gas to lift said sheet portion from said photoconductor.

* * * * *